US006687992B2

(12) United States Patent
Quesada et al.

(10) Patent No.: US 6,687,992 B2
(45) Date of Patent: Feb. 10, 2004

(54) ASSEMBLY METHOD FOR HERMETIC SCROLL COMPRESSOR

(75) Inventors: John F. Quesada, Williamsville, NY (US); Neil K. McCoy, Newfane, NY (US); Anton D. W. Heinrichs, Wilson, NY (US)

(73) Assignee: Delphi Technologies, Inc., Troy, MI (US)

( * ) Notice: Subject to any disclaimer, the term of this patent is extended or adjusted under 35 U.S.C. 154(b) by 50 days.

(21) Appl. No.: 10/047,886

(22) Filed: Jan. 14, 2002

(65) Prior Publication Data

US 2003/0133818 A1 Jul. 17, 2003

(51) Int. Cl.[7] ..... B23P 15/00

(52) U.S. Cl. ..... 29/888.022; 29/888.02; 29/464

(58) Field of Search ..... 29/888.022, 888.02, 29/464, 521, 525; 418/55.1, 55.5

(56) References Cited

U.S. PATENT DOCUMENTS 5,411,384 A * 5/1995 Bass et al. ..... 418/55.1
5,551,851 A * 9/1996 Williams et al. ..... 418/55.1
5,704,122 A * 1/1998 Tsubokawa et al. ... 29/888.022
5,745,992 A * 5/1998 Caillat et al. ..... 29/888.022
5,800,149 A * 9/1998 Sakai et al. ..... 418/55.2
5,931,650 A * 8/1999 Yasu et al. ..... 418/55.3
5,984,653 A * 11/1999 Misiak ..... 418/55.1
6,142,755 A * 11/2000 Shiinoki et al. ..... 418/55.2
6,193,484 B1 * 2/2001 Hahn et al. ..... 418/55.1
6,247,910 B1 * 6/2001 Yokoyama ..... 418/55.1
6,264,443 B1 * 7/2001 Barito ..... 418/1
6,488,489 B2 * 12/2002 Williams et al. ..... 418/55.1

* cited by examiner

*Primary Examiner*—I. Cuda Rosenbaum
(74) *Attorney, Agent, or Firm*—Patrick M. Griffin

(57) ABSTRACT

A method of fabricating a scroll compressor of the type including an electric motor in driving engagement with an orbiting scroll member having an orbiting scroll vane in a shell extending along an axis between open ends. The method includes the steps of orientating the fixed scroll member angularly about the axis of the shell relative to the orbiting scroll member, and pressing the fixed scroll member having a fixed scroll vane axially into sealing engagement with the shell and into a predetermined spaced relationship with the orbiting scroll member with the scroll vanes of the scroll members in axially overlapping relationship for pumping action between the vanes.

12 Claims, 8 Drawing Sheets

ASSEMBLY METHOD FOR HERMETIC SCROLL COMPRESSOR

FIELD OF THE INVENTION

The subject invention relates to an electrically driven scroll type of compressor and, more specifically, to a method of fabricating such and assembly.

BACKGROUND OF THE INVENTION

The scroll compressors of the type to which the subject invention pertains include an electric motor in driving engagement with an orbiting scroll member having an orbiting scroll vane overlapping a fixed vane of a fixed scroll member. Examples of same are shown in U.S. Pat. No. 5,800,149 to Sakai et al and U.S. Pat. No. 5,931,650 to Yasu et al. The electric motor includes a rotor shaft rotatably supported between a main bearing support and a lower bearing support, which are, in turn, supported in a shell extending along an axis between open ends. Such scroll compressors require precise positional alignment of the fixed scroll member relative to the orbiting scroll member. The current art uses fasteners to secure the fixed scroll member to the main bearing support, and shims to establish a precise and selected axial gap between the scroll members. The orbiting scroll member is aligned to the main bearing support through an anti-rotation means precisely machined into the main bearing support and orbiting scroll member. The fixed scroll member is aligned to the main bearing support by precision assembly fixturing, alignment dowels or other precise means and subsequently fastened to the main bearing support with screws. Typically, shims are selected and placed between the fixed scroll member and the surface on the main bearing support that it seats against to establish a precise gap between the each vane and opposing scroll member.

There is a need for a method of assembly that eliminates the shims, pins, and fasteners required in the present art.

SUMMARY OF THE INVENTION AND ADVANTAGES

The subject invention provides a method of fabricating a scroll compressor of the type including an electric motor in driving engagement with an orbiting scroll member having an orbiting scroll vane overlapping a fixed vane of a fixed scroll member, all of which are housed in a shell extending along an axis between open ends. The method includes the steps of orientating the fixed scroll member angularly about the axis of the shell relative to the orbiting scroll member and then pressing the fixed scroll member axially into sealing engagement with the shell and into a predetermined spaced relationship with the orbiting scroll member with the scroll vanes of the scroll members in axially overlapping relationship for pumping action between the vanes.

The advantages of the subject invention include reduced cost through part elimination, improved quality due to reduction in accumulated tolerances of mating parts, and improvement in manufacturing processing due to the elimination of "select-fit" processing. A drastic reduction in compressor size (diameter) can be realized by this utilizing this invention.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
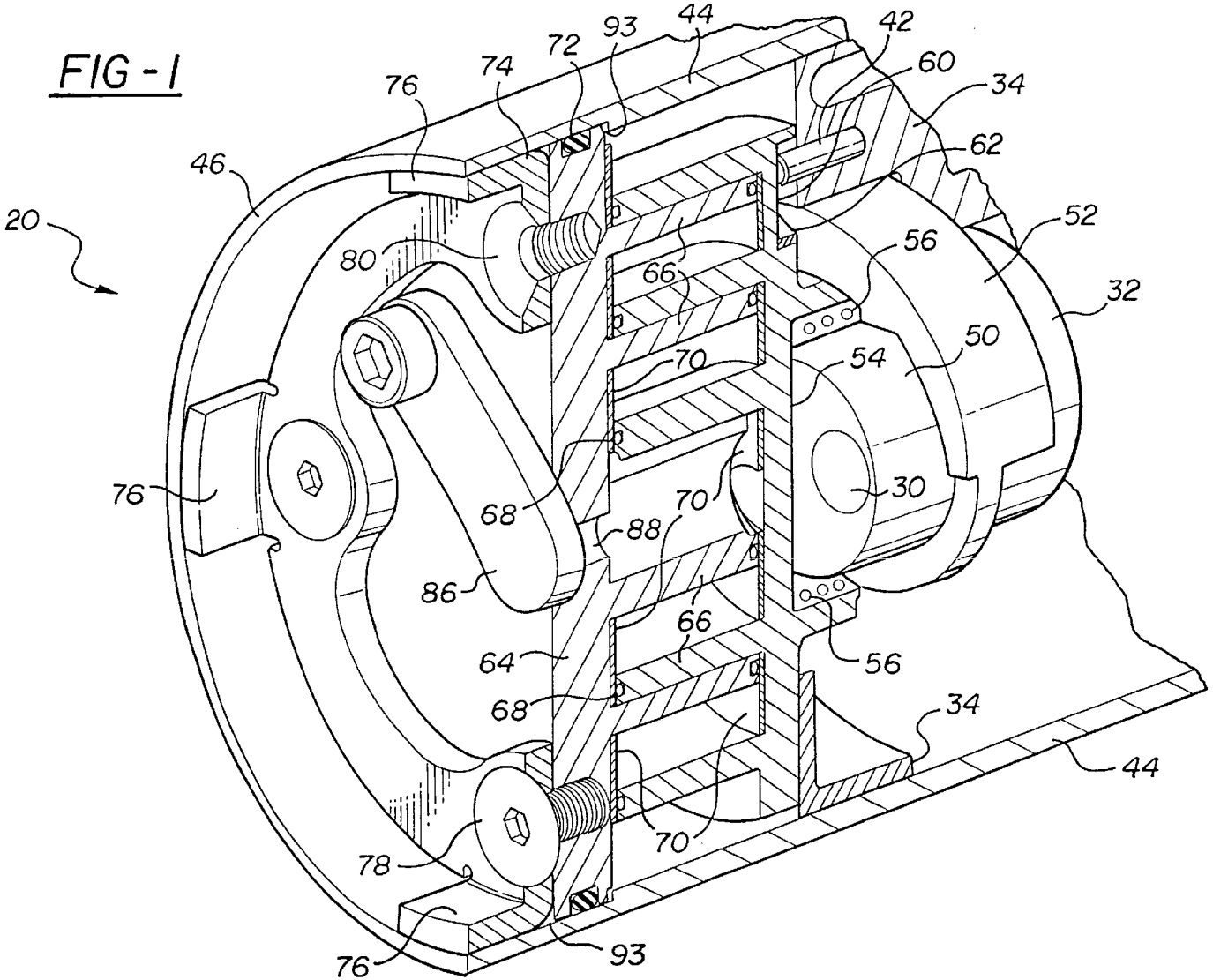
FIG. 1 is a fragmentary perspective view of the scroll compressor assembly of the subject invention.

Referring to the drawings, wherein like numerals indicate like or corresponding parts throughout the views, a scroll compressor or pump assembly fabricated in accordance with the subject invention is generally shown at 20.

The compressor assembly 20 comprises an electric motor including a stator 22, a rotor shaft 24, and a rotor 26 supported on the shaft 24. Counterweights 27 are attached to the shaft 24. The rotor shaft 24 has a main bearing flange 28 and an eccentric 30. A main bearing 32 surrounds the flange 28 and rotatably supports the rotor shaft 24 and a main bearing support 34 supports the main bearing 32.

A lower bearing support 36 supports a lower bearing 38 in axially spaced relationship to the main bearing 32. A screw 40 threadedly engages the end of the rotor shaft 24 to hold the lower bearing 38 in an annular groove at the end of the shaft 24.

A locating pin 42 extends axially from the main bearing support 36, the purpose of which will become clear hereinafter.

A cylindrical shell 44 extends along an axis between open ends 46, 48 and into a tight fit about the bearing supports 34, 36 and the stator 22 of the electric motor.

A swing bushing 50 is disposed on the eccentric 30 and a counterweight 52 is disposed about the swing bushing 50. An orbiting scroll member 54 is disposed on the swing bushing 50 via a scroll bearing 56. The orbiting scroll member 54 has an orbiting scroll vane 58, or a plurality of such vanes, and three equally spaced circular locating recesses 60, in which is disposed a bearing ring 62 for locating and guiding the orbiting movement of the pin 42. In other words, the locating pin 42 extends into the locating recesses 60 for locating the angular position of the orbiting scroll member 54.

A fixed scroll member 64 presents a fixed scroll vane 66, or a plurality of such vanes. The fixed scroll member 64 is in sealing engagement with the interior of the shell 44 in a predetermined spaced relationship with the orbiting scroll member 54 with the scroll vanes 58, 66 of the scroll members 54, 64 in axially overlapping relationship for pumping action between the vanes 58, 66 in response to rotation of the rotor shaft 24. Tip seals 68 are disposed in the ends of the vanes 58, 66 and engage wear plates 70 in the bottoms of the respective scroll members 54, 64. An o-ring 72 is disposed in the circular periphery of the fixed scroll member 64 to seal against the interior of the shell 44.

An anchor plate 74 is secured to the fixed scroll member 64 by plurality of fasteners in the form of bolts or screws 78 extending through counterbored holes 80 in the anchor plate 74. The anchor plate 74 has an outside diameter less than the outside diameter of the fixed scroll member 64 that is pressed into the shell 44 to form a press fit. The anchor plate 74 includes axially extending tabs 76, which are welded to the shell 44. The assembly is closed by end caps 82 (only one shown) secured, as by welding, to the respective ends 46, 48 of the shell 44.

A reed valve comprising a flexible valve strip 84 and a backing or stop element 86 overlies a hole 88 in the fixed scroll member 64 for expelling compressed fluid.

The method of assembling the scroll compressor 20 is illustrated in FIGS. 6 through 12.

Figure 2:
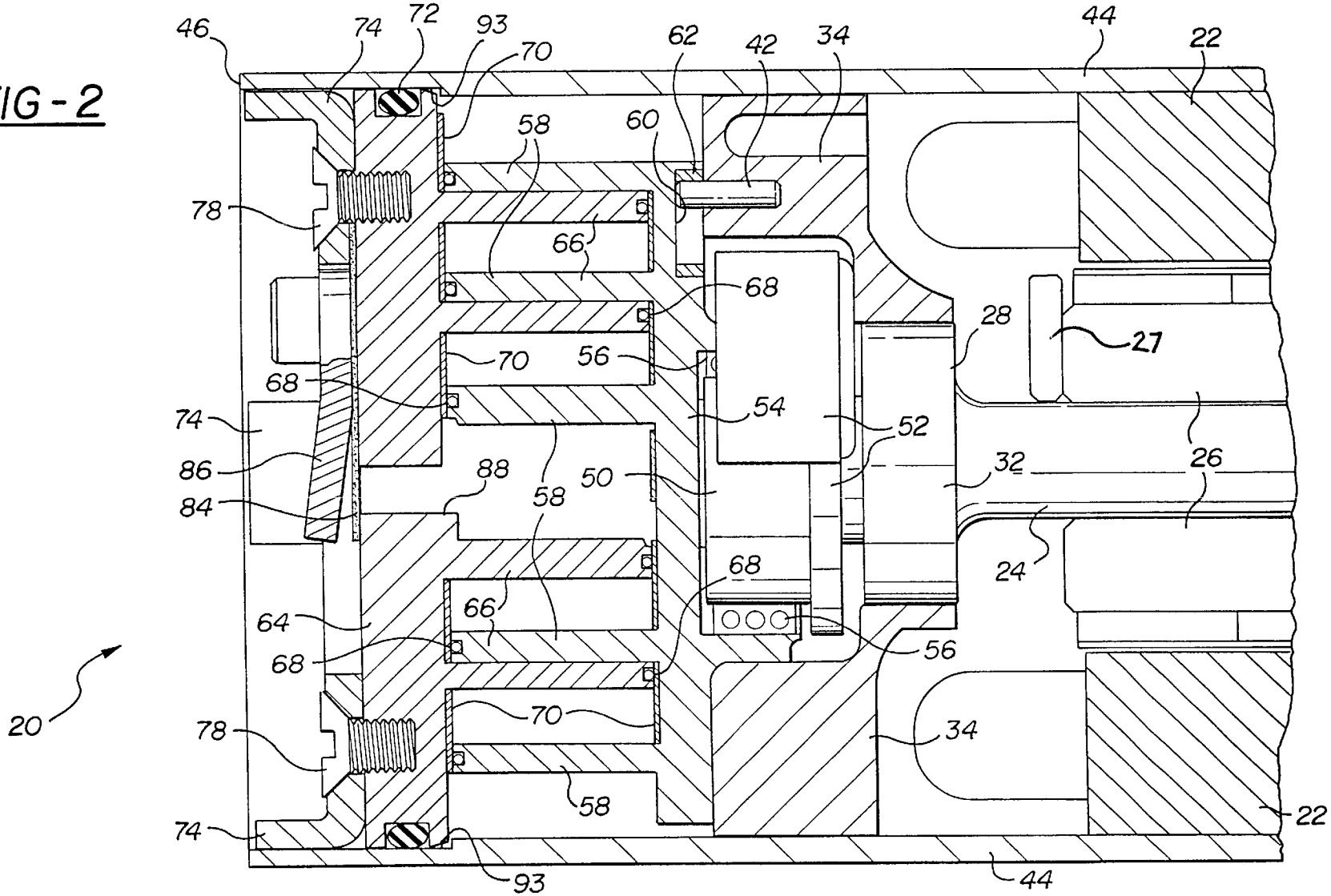
FIG. 2 is a fragmentary cross-sectional view of the assembly shown in FIG. 1.
Figure 3:
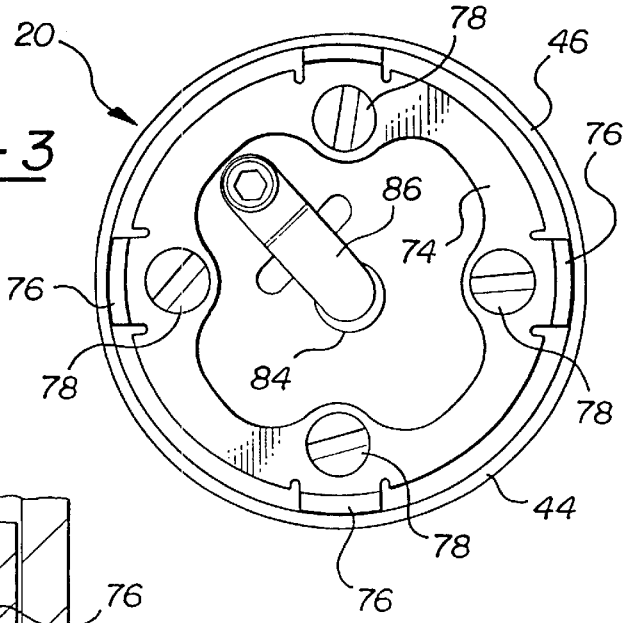
FIG. 3 is and end view of the end shown in FIG. 2.
Figure 4:
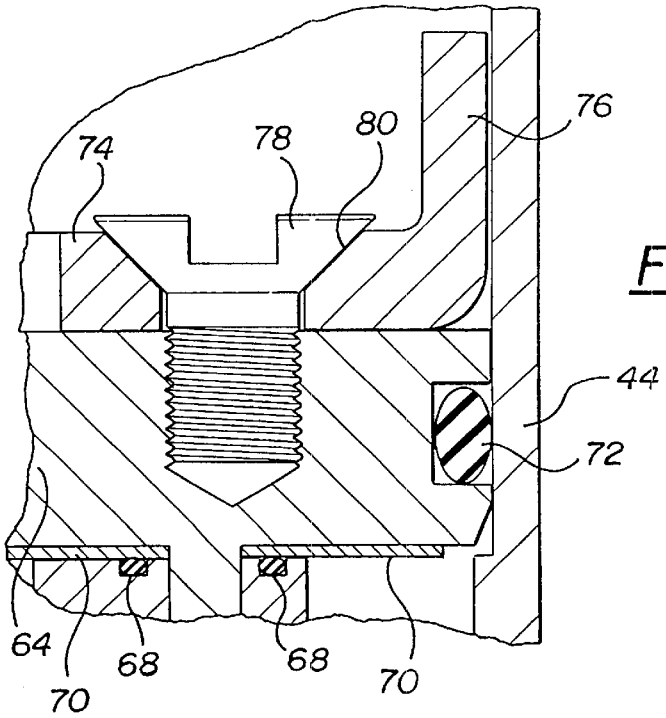
FIG. 4 is an enlarged fragmentary view showing the fixed scroll member bolted to the anchor plate.
Figure 5:
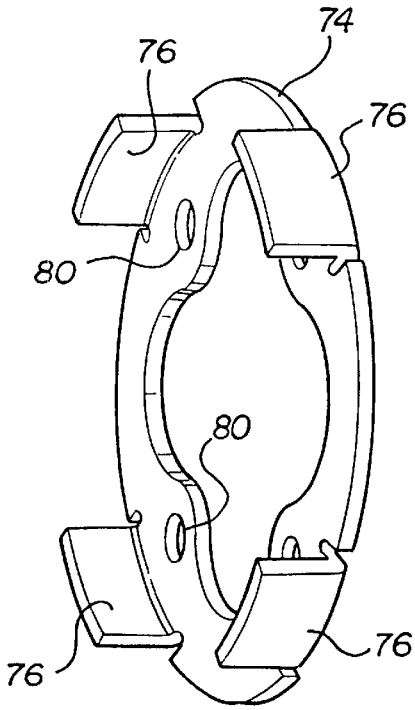
FIG. 5 is a perspective view of the anchor plate.
Figure 6:
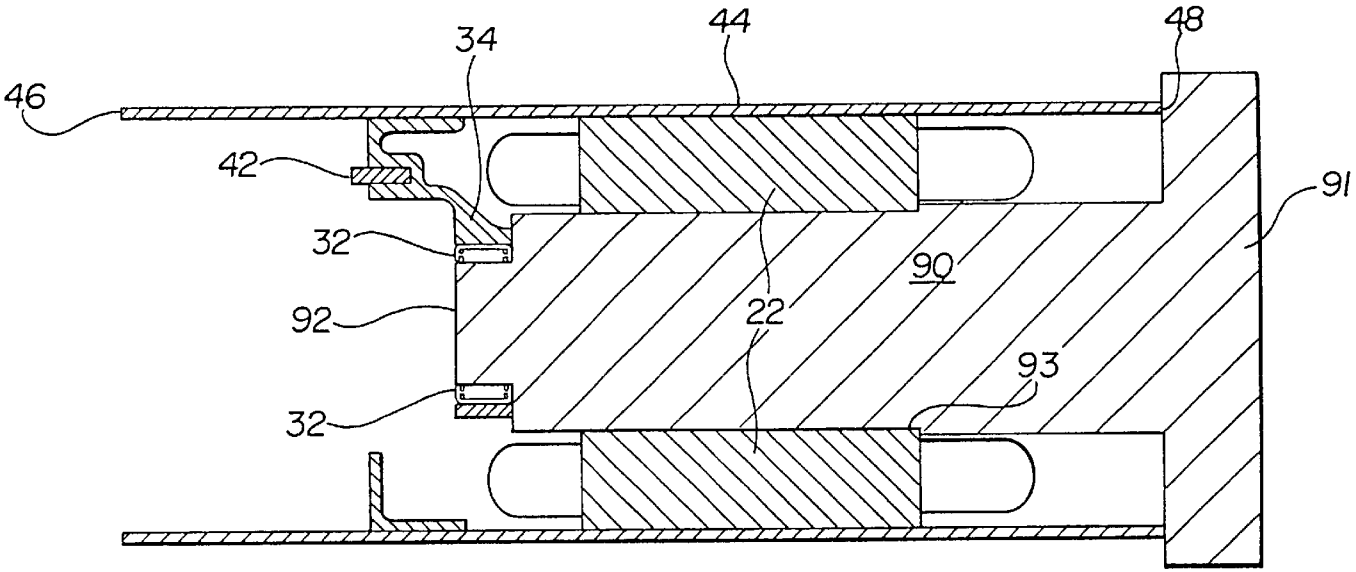
FIG. 6 is a cross sectional view showing the insertion of the electric motor stator and main bearing support into the shell.
Figure 8:
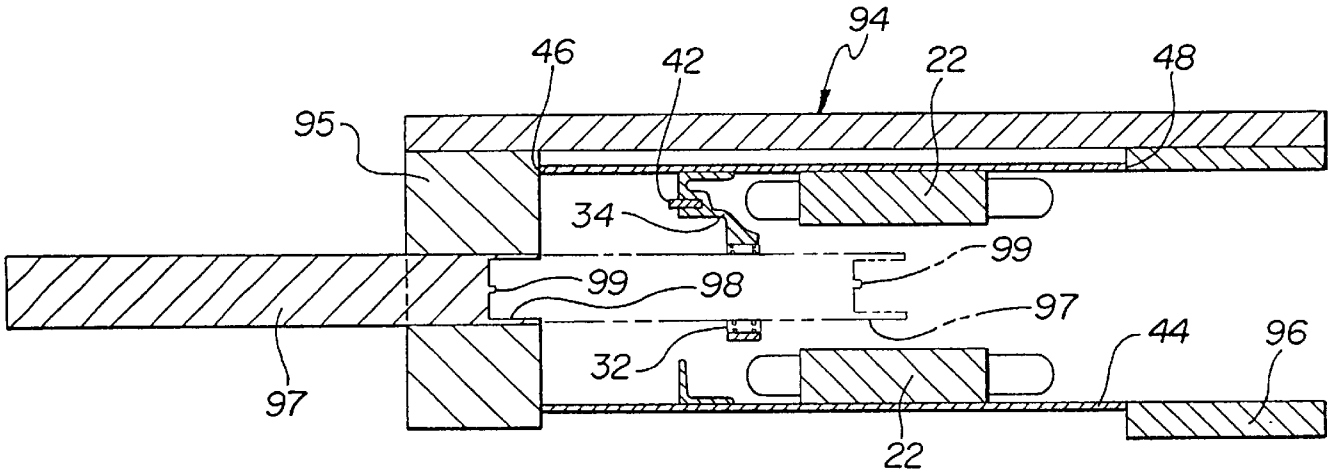
FIG. 8 is a cross sectional view showing the frame and arbor with the arbor shown inserted through the main bearing in phantom.
Figure 7:
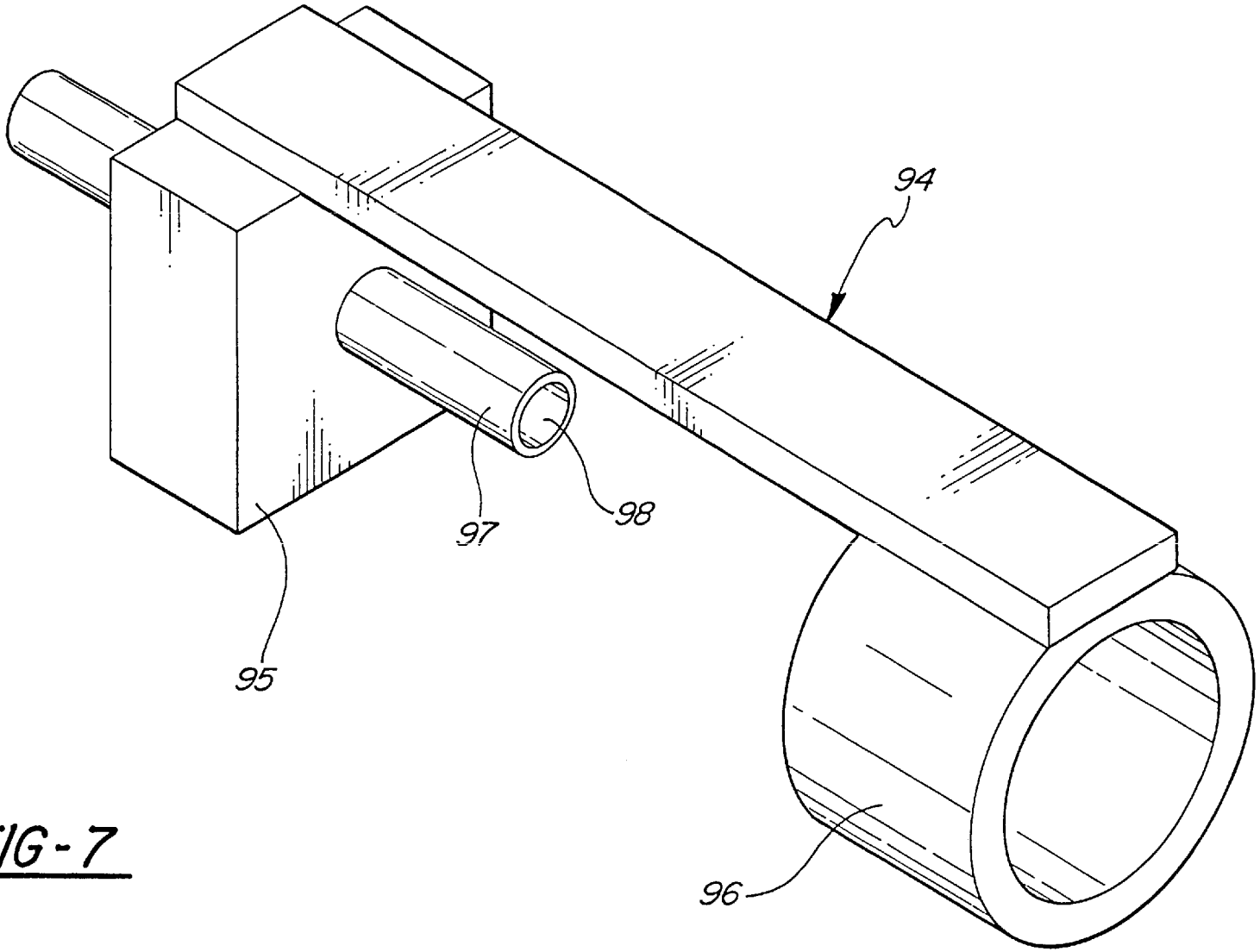
FIG. 7 is a perspective view of the fixturing frame used to insert the electric motor stator.

The sub-assembly shown in FIG. 6 is fabricated in a first station, whereby the shell 44 is assembled to the main bearing support, or thrust body, 34 and stator 22 by a shrink fit. Included are the steps of assembling the electric motor stator 22 onto a stem 90 of a body having a head 91 at one end and a bearing guide 92 at the other end of the stem 90. The stem 90 includes a shoulder 93 for receiving the stator 22 and the bearing guide 92 comprises an annular projection defining a shoulder for receiving the bearing 32. Therefore, the main bearing 32 and main bearing support 36 are disposed on the bearing guide 92 with three equally spaced locating pins 42 extending axially from the main bearing support 34. The cylindrical shell 44 is heated, as in an induction heating cell, and the body is inserted into one end 48 of the shell 44 so that the head 91 engages that end of the shell 44. The shell 44 is machined on the interior diameter for precisely mating with the main bearing support 34. The main bearing 32 is pressed into the main bearing support 34. The insertion can be accurately controlled to precisely position that main bearing support 34 axially within the shell 44, e.g., the distance from the head 91 along the shell 44 as the end 48 engages the head 91. The shell 44 is machined to a precise length, outside diameter break edge chamfers, internal diameter lead chamfers and with a shoulder 93 (FIGS. 1 and 2), or the like, for receiving the fixed scroll member 64. Although not shown, the stem 90 and head 91 would include a passage for lead wires for the stator 22.

Cooling of the shell 44 draws the internal diameter of the shell 44 into a shrink fit about the stator 22 and main bearing support 36, such cooling being in a cooler or by ambient conditions. Thereafter, the body 90, 91, 92 is removed from the stator 22 and shell 44.

In the second station, the rotor shaft 24 and lower bearing support 36 are inserted into the shell 44. This is accomplished by supporting the shell 44 in a positioning frame, generally indicated at 94 in FIGS. 7 through 10. The frame 94 has an arbor guide 95 engaging one end 46 of the shell 44 and a rotor guide 96 engaging the other end 48 of the shell 44 with the rotor guide 96 having an internal diameter aligned with the internal diameter of the shell 44, i.e., the internal diameters are the same size.

A shaft alignment arbor 97 is slidably supported by the arbor guide 95 and is inserted through the main bearing 32 by a press, or the like. The end of the arbor 97 inserted through the bearing has a rotor shaft alignment pocket 98.

The sub-assembly including the electric motor rotor 26 on the rotor shaft 24 is pre-fabricated or assembled by supporting the rotor shaft 24 in the lower bearing 38, which is, in turn, supported on the lower bearing support 36. The main bearing flange 28 is of the same diameter and engages the end of the alignment arbor 97 and the eccentric 30 extends into the pocket 98 of the alignment arbor 97. The rotational orientation of the rotor shaft 24 is attained by a projection 99 in the bottom of the pocket 98 engaging an alignment recess in the end of the rotor shaft 24.

Figure 9:
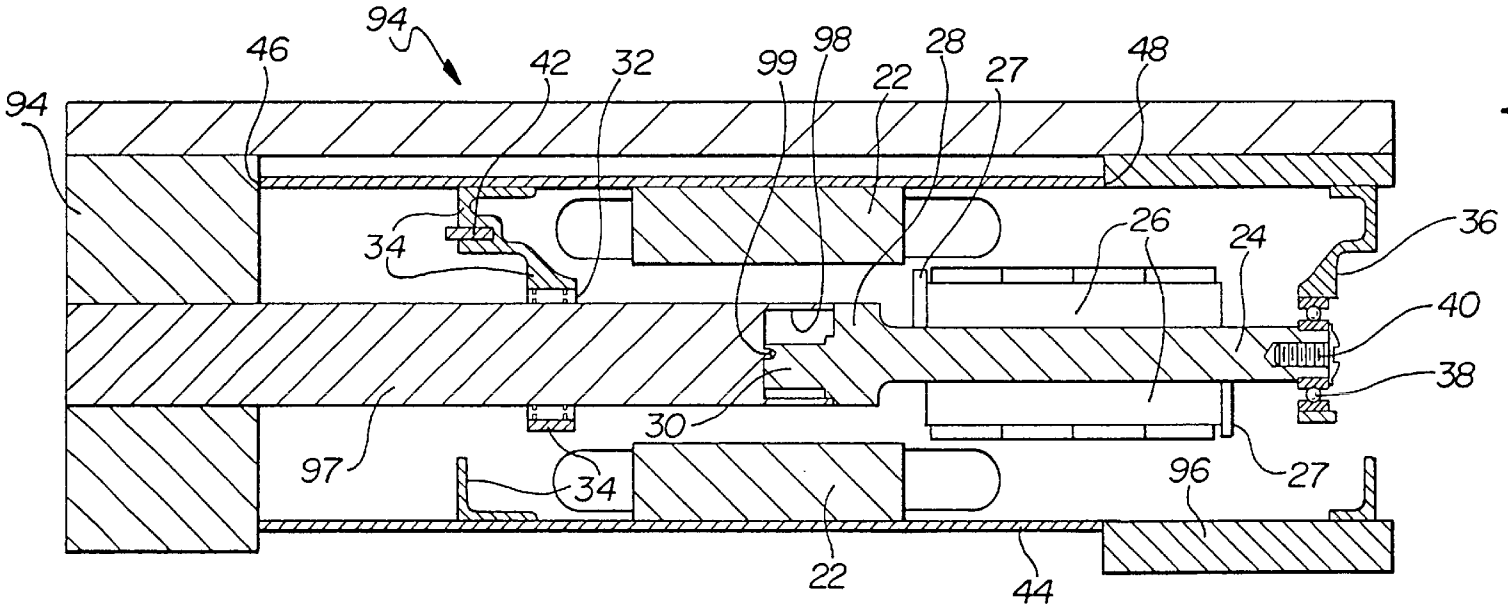
FIG. 9 is a cross sectional view showing the rotor shaft, lower bearing support and rotor initially inserted into the frame and ready for insertion into the shell.
Figure 10:
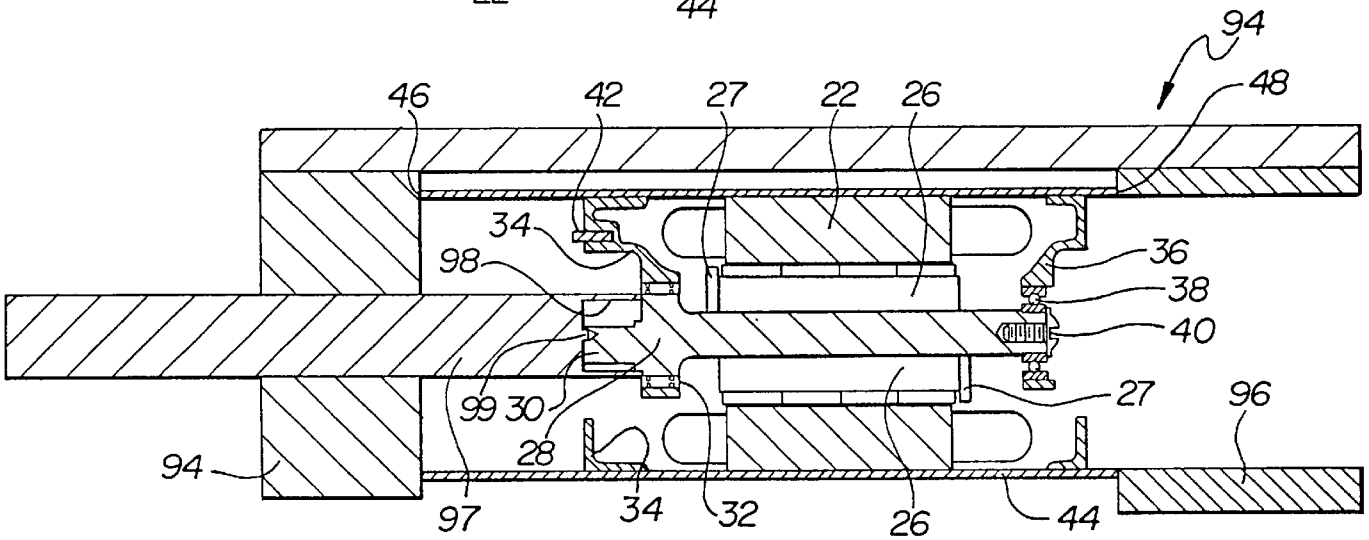
FIG. 10 is cross sectional view like FIG. 9 but showing the rotor and lower bearing support moved axially into the shell.
Figure 11:
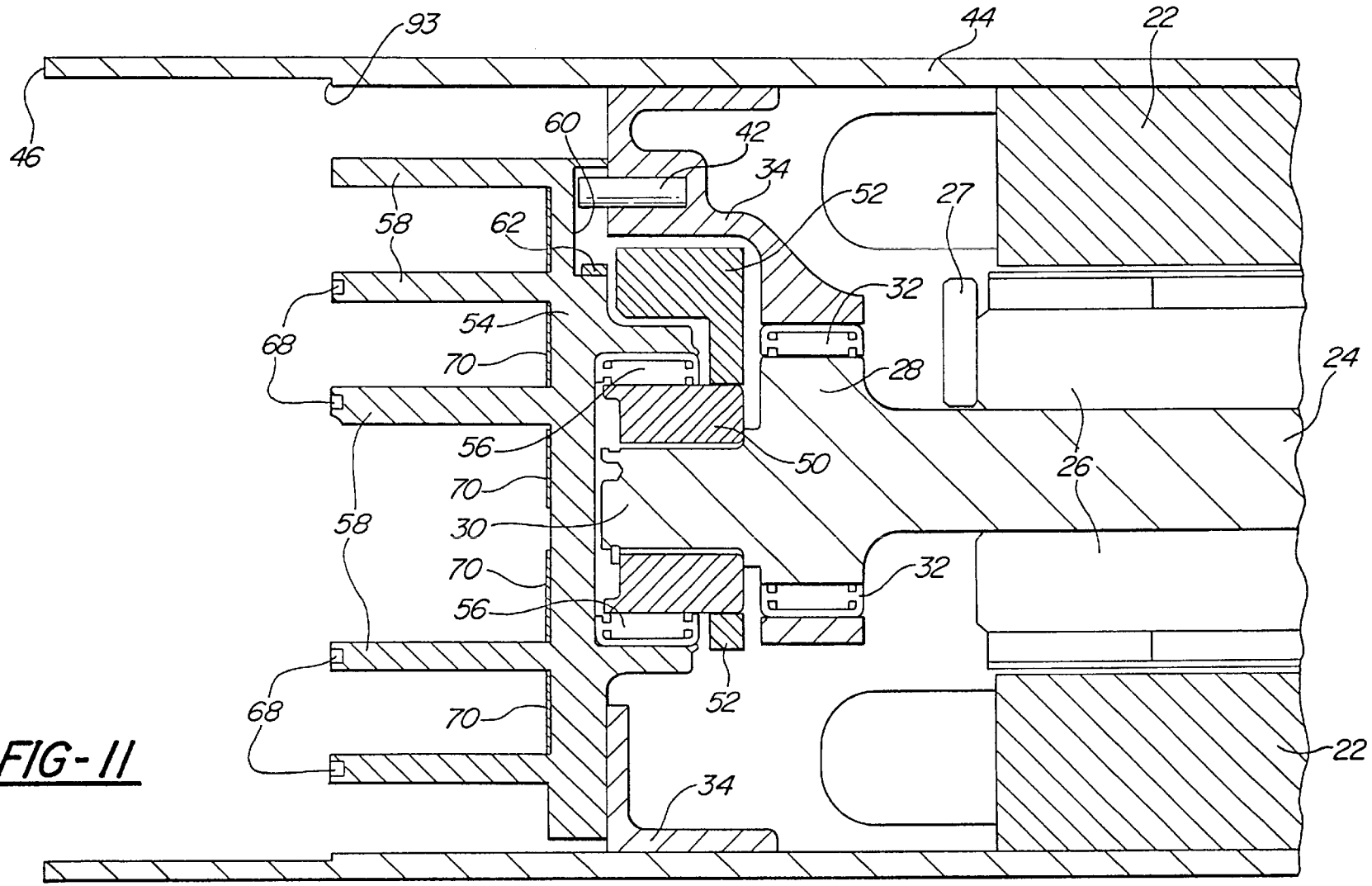
FIG. 11 is a cross sectional view showing the orbiting scroll member and associated parts placed in position.
Figure 12:
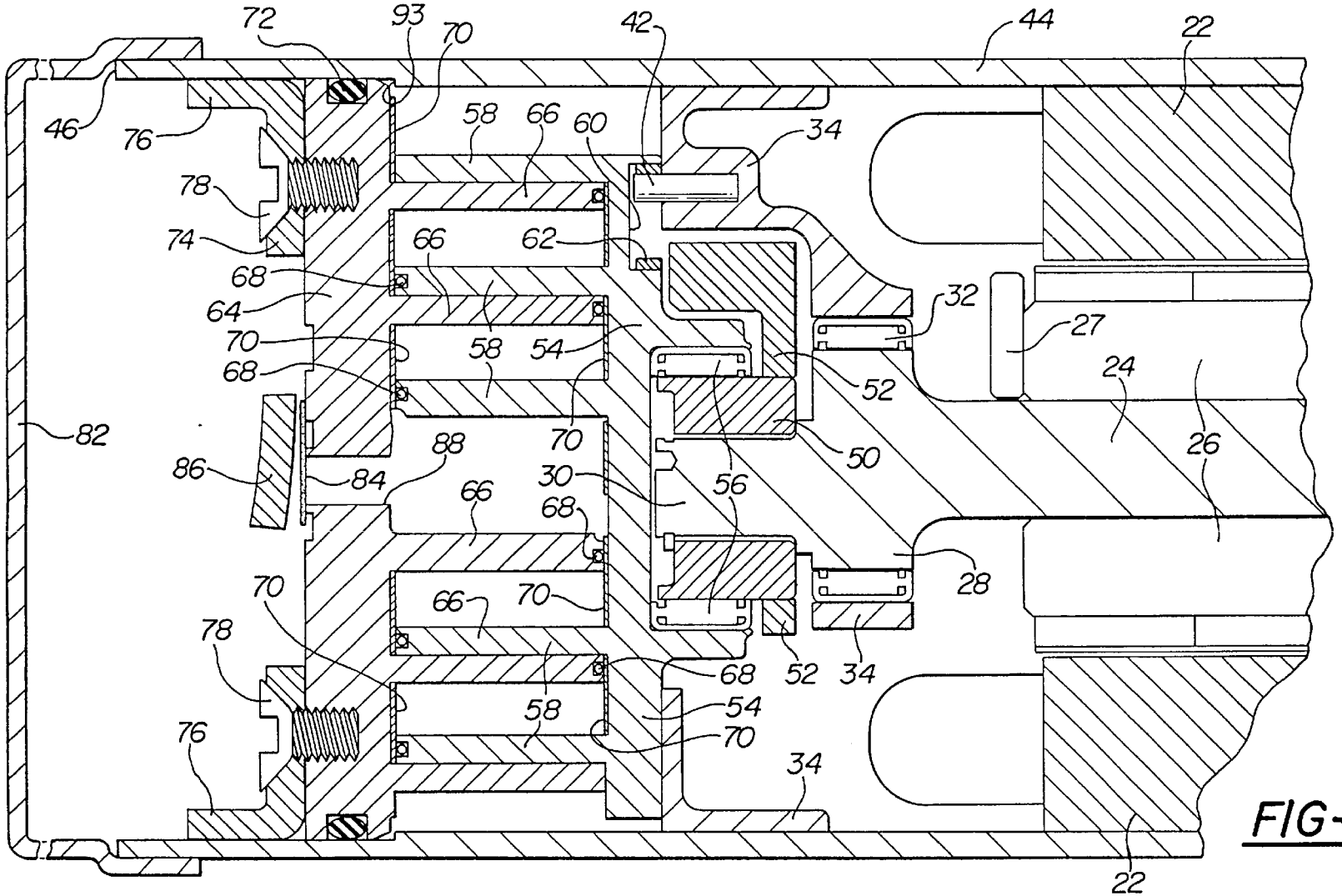
FIG. 12 is a cross sectional view showing the insertion of the fixed scroll member and anchor plate into position with the vanes of the respective scroll members in overlapping relationship for pumping therebetween in response to rotation of the rotor shaft.

The lower bearing support 36 is placed into the rotor guide 96 with the lower bearing support 36 in sliding engagement with the internal diameter of the rotor guide 96 and the rotor 26 in axially spaced relationship to the stator 22, as shown in FIG. 9. Thereafter, the lower bearing support 36 is forced or pushed by an arbor in a press to move axially into a force fit with the internal diameter of the shell 44 while maintaining the rotor 26 radially spaced from and inside the stator 22 as the rotor 26 is moved axially into the stator 22. The guide 96 guides the lower bearing support 36 into the shell 44, as they are both of the same internal diameter. While performing this step, the flange 28 of the rotor shaft 24 is guided into the main bearing 32 as the end of the rotor shaft 24 moves the alignment arbor 97 axially out of the main bearing 32. As will be appreciated, both ends of the rotor shaft 24 are supported as this sub-assembly is inserted into the shell 44. Once in the position shown in FIG. 10, the arbor 97 is retracted and the shell 44 is removed form the frame 94.

The swing bushing 50 and counterweight 52 sub-assembly is manually mounted on the eccentric 30. The orbiting scroll member 54 is disposed about the swing bushing 50 and bearing 56 while locating the angular position of the orbiting scroll member 54 by inserting the locating pins 42 in the locating recesses 60.

In a separate sub-assembly, bolts 78 attach the fixed scroll member 64 to the anchor plate 74. The anchor plate 74 may be bolted to the fixed scroll 64 at a first predetermined distance by placing shims or spacers between the bolts 78 and the anchor plate 74. As alluded to above, an o-ring 72 is disposed in the circular periphery of the fixed scroll member 64. The o-ring 72 and an o-ring gland may be employed in conjunction with the machined internal diameter of the shell 44 to radially position the fixed scroll member 64 for proper alignment with the orbiting scroll member 54. Additionally, a machined feature (a notch) in the main bearing support 34 that is accessible after the orbiting scroll member 54 is inserted whereby the angular position of the fixed scroll member 64 is orientated for proper alignment with the orbiting scroll member 54. Various alternatives may be used for orientating the fixed scroll member 64 angularly about the axis of the shell 44 relative to the orbiting scroll member 54.

In the third station, the fixed scroll member 64 is pressed axially into sealing engagement with the shell 44 and into a predetermined spaced relationship with the orbiting scroll member 54. In this position, the scroll vanes 58, 66 of the scroll members 54, 64 are in axially overlapping relationship for pumping action between the vanes 58, 66 in response to rotation of the rotor shaft 24. The press of the fixed scroll member 64 into the shell 44 the precise distance may be attained by precise positioning of the shell 44 relative to the stroke of the press used to force the fixed scroll member 64 into the shell 44. An alternative would be to bring the fixed scroll member 64 and anchor plate 74 up to a temperature which would expand the flank length to the desired tip gap between the respective vanes 58, 66. Another alternative is to place shims between the fixed scroll member 64 and the anchor plate 74 with the bolts 78 tightened. The fixed scroll member 64 is inserted into contact with the orbiting scroll member 54. After the tabs 76 of the anchor plate 74 are welded to the shell 44, the bolts 78 are loosened and the shims removed. The bolts 78 are re-tightened to move the fixed scroll member 64 axially relative to the orbiting scroll member 54 to a predetermined spacing therebetween.

A pair of end caps 82 are welded to the respective ends 46, 48 of the shell 44 to complete the hermetic assembly. The suction porting and electrical connections would pass through one end cap while the discharge plumbing would pass through the other end cap.

Accordingly, a scroll compressor is contained hermetically in a steel shell 44. The main bearing support 34 of the compressor is fitted in a steel shell via interference fit, while the fixed scroll 64, machined from aluminum, is fitted with an anchor plate 74, and subsequently fitted in the compressor shell 44. Diametrical position is maintained by precise machining of the OD of the fixed scroll member 64, which maintains a light transitional fit to the inner diameter of the steel shell 44. The angular position of this fixed scroll member 64 is maintained by fixturing and datums and the axial position are established by a precision press operation. A precision press process monitors the exact depth of press of the fixed scroll member 64, while the fitment of the OD of fixed scroll member 64 to shell ID holds the fixed scroll member 64 in place. In subsequent manufacturing operations, the flanged portion or tabs 76 of anchor plate 74, which maintains a small clearance to the ID of the shell 44, 110 permitting precision diametrical position of fixed scroll member 64, is welded to the shell 44 by a through-welding process which penetrates from outside of the shell 44 in through to the tabs 76 of the anchor plate 74. The welding of the tabs 76 may consist of a electric resistance weld process or other, minimal and localized heat welding processes would acceptably secure the anchor plate 74. The process yields a strong, precise fit of the fixed scroll member 64 and maintains with precision the exact gap between fixed 64 and orbiting 54 scroll members without the use of shims, spacers, or other additional hardware.

An alternative to the welded anchor plate 74 is to machine the OD of the fixed scroll member 74 for a press fit, and rely on the press fit for securing it to the steel shell 44. The anchor plate 74 version is detailed for the aluminum fixed scroll member 64 due to differences in thermal expansion between aluminum and steel, and the difficulties that the thermal expansion differences would create in maintaining the proper press fit under operation. A fixed scroll member 64 machined from a ferrous material would maintain adequate press fit as its thermal expansion rate would be nearly identical to that of the shell 44.

Obviously, many modifications and variations of the present invention are possible in light of the above teachings. The invention may be practiced otherwise than as specifically described within the scope of the appended claims.

What is claimed is:

1. A method of fabricating a scroll compressor comprising the steps of;

disposing an electric motor in driving engagement with an orbiting scroll member having an orbiting scroll vane in a shell having an axis extending between open ends, orientating a fixed scroll member angularly about the axis of the shell relative to the orbiting scroll member, and pressing the fixed scroll member having a fixed scroll vane axially into sealing engagement with the shell and into a predetermined spaced relationship with the orbiting scroll member with the scroll vanes of the scroll members in axially overlapping relationship for pumping action between the vanes, including the steps of attaching an anchor plate to the fixed scroll member with the anchor plate having an outside diameter less than the outside diameter of the fixed scroll member, and securing the anchor plate to the shell.

2. A method as set forth in claim 1 further defined as including the steps of bolting the anchor plate to the fixed scroll at a first predetermined distance, disposing the fixed scroll member in contact with the orbiting scroll member, securing the anchor plate to the shell, adjusting the fixed scroll member axially relative to said anchor plate to said predetermined spaced relationship with said orbiting scroll member.

3. A method as set forth in claim 1 further defined as including the step of welding the anchor plate to the shell.

4. A method as set forth in claim 1 wherein the disposing of the electric motor and orbiting scroll in the shell is further defined by heating the shell and inserting the electric motor into the shell and cooling the shell into a shrink fit with the electric motor.

5. A method as set forth in claim 4 defined as including the steps of;

pre-assembling a stator of the electric motor onto a stem of a body having a head at one end and a bearing guide at the other end of the stem, and disposing a main bearing and main bearing support on the bearing guide, and inserting the body into the heated shell and cooling the shell into a shrink fit about the stator and main bearing support, and removing the body from the stator and shell.

6. A method as set forth in claim 5 further defined as including the steps of supporting the shell in a positioning frame having an arbor guide engaging one end of the shell and a rotor guide, engaging the other end of the shell with the rotor guide having an internal diameter aligned with the internal diameter of the shell.

7. A method as set forth in claim 6 further defined as including the steps of;

inserting a shaft alignment arbor through the main bearing with the end of the arbor inserted through the main bearing having a rotor shaft alignment pocket, supporting a rotor of the electric motor on a rotor shaft having a main bearing flange of the same diameter and engaging the end of the alignment arbor and an eccentric extending into the pocket of the alignment arbor, supporting the rotor shaft in a lower bearing, supporting the lower bearing on a lower bearing support, placing the lower bearing support into the rotor guide with the lower bearing support in sliding engagement with the internal diameter of the rotor guide and the rotor in axially spaced relationship to the stator, and forcing the lower bearing support to move axially into a force fit with the interior of the shell while maintaining the rotor radially spaced from the stator as the rotor is moved axially into the stator and while guiding the flange of the rotor shaft into the main bearing as the end of the rotor shaft moves the alignment arbor axially out of the main bearing.

8. A method as set forth in claim 7 further defined as including the steps of;

disposing a swing bushing on the eccentric, disposing a counterweight about the swing bushing, disposing the orbiting scroll member onto the swing bushing while locating the angular position of the orbiting scroll member.

9. A method as set forth in claim 8 further defined as including the step of disposing an O-ring in the circular periphery of the fixed scroll member.

10. A method as set forth in claim 9 further defined as including the step of welding end caps to the respective ends of the shell.

11. A method of fabricating a scroll compressor comprising the steps of assembling an electric motor stator onto a stem of a body having a head at one end and a bearing guide at the other end of the stem, disposing a main bearing and main bearing support on the bearing guide with a locating pin extending axially from said main bearing support, heating a cylindrical shell extending along an axis between open ends and inserting the body into the shell, cooling the internal diameter of the shell into a shrink fit about the stator and main bearing support, removing the body from the stator and shell, supporting the shell in a positioning frame having an arbor guide engaging one end of the shell and a rotor guide engaging the other end of the shell with the rotor guide having an internal diameter aligned with the internal diameter of the shell, inserting a shaft alignment arbor through the main bearing with the end of the arbor inserted through the main bearing having a rotor shaft alignment pocket, supporting an electric motor rotor on a rotor shaft having a main bearing flange engaging the end of the alignment arbor and an eccentric extending into the pocket of the alignment arbor, supporting the rotor shaft in a lower bearing, supporting the lower bearing on a lower bearing support, placing the lower bearing support into the rotor guide with the lower bearing support in sliding engagement with the internal diameter of the rotor guide and the rotor in axially spaced relationship to the stator, forcing the lower bearing support to move axially into a force fit with the internal diameter of the shell while maintaining the rotor radially spaced from the stator as the rotor is moved axially into the stator and while guiding the flange of the rotor shaft into the main bearing as the end of the rotor shaft moves the alignment arbor axially out of the main bearing, disposing a swing bushing on the eccentric, disposing a counterweight about the swing bushing, disposing an orbiting scroll member having an orbiting scroll vane and at least one locating recess onto the swing bushing while locating the angular position of the orbiting scroll member by inserting at least one locating pin in each of the locating recesses, bolting a fixed scroll member having a fixed scroll vane to an anchor plate including axially extending tabs having an outside diameter less than the outside diameter of the fixed scroll member, disposing an o-ring in the circular periphery of the fixed scroll member, orientating the fixed scroll member angularly about the axis of the shell relative to the orbiting scroll member, pressing the fixed scroll member axially into sealing engagement with the shell and into a predetermined spaced relationship with said orbiting scroll member with the scroll vanes of the scroll members in axially overlapping relationship for pumping action between the vanes in response to rotation of the rotor shaft, welding the tabs to the shell, and welding end caps to the respective ends of the shell.

12. A method as set forth in claim 11 further defined as bolting the anchor plate to the fixed scroll at a first predetermined distance, disposing the fixed scroll member in contact with the orbiting scroll member securing the anchor plate to the shell, adjusting the bolting and to move the fixed scroll member axially relative to said anchor plate to said predetermined spaced relationship with said orbiting scroll member.

* * * * *